US010513755B2

(12) United States Patent
Bryan

(10) Patent No.: US 10,513,755 B2
(45) Date of Patent: Dec. 24, 2019

(54) HIGH STRENGTH ALPHA/BETA TITANIUM ALLOY FASTENERS AND FASTENER STOCK

(75) Inventor: David J. Bryan, Indian Trail, NC (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

(21) Appl. No.: 12/903,851

(22) Filed: Oct. 13, 2010

(65) Prior Publication Data

US 2012/0076612 A1 Mar. 29, 2012

Related U.S. Application Data

(63) Continuation-in-part of application No. 12/888,699, filed on Sep. 23, 2010, now abandoned.

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22F 1/183; C22C 14/00
USPC ..... 148/669–671, 421; 420/417–421
See application file for complete search history.

(56) References Cited

U.S. PATENT DOCUMENTS 2,857,269 A 10/1958 Vordahl
2,893,864 A 7/1959 Harris et al.
2,932,886 A 4/1960 Althouse
2,974,076 A 3/1961 Vordahl
3,015,292 A 1/1962 Bridwell
3,025,905 A 3/1962 Haerr
3,060,564 A 10/1962 Corral
3,082,083 A 3/1963 Levy et al.
3,117,471 A 1/1964 O'Connell et al.
3,313,138 A 4/1967 Spring et al.
3,379,522 A 4/1968 Vordahl
3,436,277 A 4/1969 Bomberger, Jr. et al.
3,469,975 A 9/1969 Bomberger, Jr. et al.
(Continued)

FOREIGN PATENT DOCUMENTS

CA 2787980 A 7/2011
CN 1070230 A 3/1993
(Continued)

OTHER PUBLICATIONS

ATI 425 (High-Strength Titanium Alloy), Alloy Digest, ASM International, Jul. 2004.*

(Continued)

*Primary Examiner* — Vanessa T. Luk
(74) *Attorney, Agent, or Firm* — K&L Gates LLP; Robert J. Toth

(57) ABSTRACT

An article of manufacture selected from a titanium alloy fastener and a titanium alloy fastener stock including an alpha/beta titanium alloy comprising, in percent by weight: 3.9 to 4.5 aluminum; 2.2 to 3.0 vanadium; 1.2 to 1.8 iron; 0.24 to 0.3 oxygen; up to 0.08 carbon; up to 0.05 nitrogen; titanium; and up to a total of 0.3 of other elements. In certain embodiments, article of manufacture has an ultimate tensile strength of at least 170 ksi (1,172 MPa) and a double shear strength of at least 103 ksi (710.2 MPa). A method of manufacturing a titanium alloy fastener and a titanium alloy fastener stock comprising the alpha/beta alloy is disclosed.

5 Claims, 5 Drawing Sheets

(56) References Cited

U.S. PATENT DOCUMENTS 3,489,617 A 1/1970 Wuerfel
3,584,487 A 6/1971 Carlson
3,605,477 A 9/1971 Carlson
3,615,378 A 10/1971 Bomberger, Jr. et al.
3,635,068 A 1/1972 Watmough et al.
3,649,259 A 3/1972 Heitman
3,676,225 A 7/1972 Owczarski et al.
3,686,041 A 8/1972 Lee
3,802,877 A 4/1974 Parris et al.
3,815,395 A 6/1974 Sass
3,835,282 A 9/1974 Sass et al.
3,922,899 A 12/1975 Fremont et al.
3,979,815 A 9/1976 Nakanose et al.
4,053,330 A 10/1977 Henricks et al.
4,067,734 A 1/1978 Curtis et al.
4,094,708 A 6/1978 Hubbard et al.
4,098,623 A 7/1978 Ibaraki et al.
4,120,187 A 10/1978 Mullen
4,138,141 A 2/1979 Andersen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,299,626 A 11/1981 Paton et al.
4,309,226 A 1/1982 Chen
4,472,207 A 9/1984 Kinoshita et al.
4,473,125 A 9/1984 Addudle et al.
4,482,398 A 11/1984 Eylon et al.
4,510,788 A 4/1985 Ferguson et al.
4,543,132 A 9/1985 Berczik et al.
4,614,550 A 9/1986 Leonard et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,798,632 A 1/1989 Yonezawa et al.
4,799,975 A 1/1989 Ouchi et al.
4,808,249 A 2/1989 Eyelon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,917,728 A 4/1990 Enright
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,330,591 A 7/1994 Vasseur
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship et al.
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,904,204 A 5/1999 Teraoka et al.
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,576,068 B2 6/2003 Grubb et al.
6,607,693 B1 8/2003 Saito et al.
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.

(56) References Cited

U.S. PATENT DOCUMENTS

| | | | |
|---|---|---|---|
| 6,786,985 | B2 | 9/2004 | Kosaka et al. |
| 6,800,153 | B2 | 10/2004 | Ishii et al. |
| 6,823,705 | B2 | 11/2004 | Fukada et al. |
| 6,908,517 | B2 | 6/2005 | Segal et al. |
| 6,918,971 | B2 | 7/2005 | Fujii et al. |
| 6,932,877 | B2 | 8/2005 | Raymond et al. |
| 6,939,415 | B2 | 9/2005 | Iseda et al. |
| 6,971,256 | B2 | 12/2005 | Okada et al. |
| 7,008,491 | B2 | 3/2006 | Woodfield |
| 7,010,950 | B2 | 3/2006 | Cai et al. |
| 7,032,426 | B2 | 4/2006 | Durney et al. |
| 7,037,389 | B2 | 5/2006 | Barbier et al. |
| 7,038,426 | B2 | 5/2006 | Hill |
| 7,081,173 | B2 | 7/2006 | Bahar et al. |
| 7,096,596 | B2 | 8/2006 | Hernandez, Jr. et al. |
| 7,132,021 | B2 | 11/2006 | Kuroda et al. |
| 7,152,449 | B2 | 12/2006 | Durney et al. |
| 7,264,682 | B2 | 9/2007 | Chandran |
| 7,269,986 | B2 | 9/2007 | Pfaffmann et al. |
| 7,332,043 | B2 | 2/2008 | Tetyukhin et al. |
| 7,410,610 | B2 | 8/2008 | Woodfield et al. |
| 7,438,849 | B2 | 10/2008 | Kuramoto et al. |
| 7,449,075 | B2 | 11/2008 | Woodfield et al. |
| 7,536,892 | B2 | 5/2009 | Amino et al. |
| 7,559,221 | B2 | 7/2009 | Horita et al. |
| 7,601,232 | B2 | 10/2009 | Fonte |
| 7,611,592 | B2 | 11/2009 | Davis et al. |
| 7,708,841 | B2 | 5/2010 | Saller et al. |
| 7,837,812 | B2 | 11/2010 | Marquardt et al. |
| 7,879,286 | B2 | 2/2011 | Miracle et al. |
| 7,947,136 | B2 | 5/2011 | Saller |
| 7,984,635 | B2 | 7/2011 | Callebaut et al. |
| 8,037,730 | B2 | 10/2011 | Polen et al. |
| 8,043,446 | B2 | 10/2011 | Jung et al. |
| 8,048,240 | B2 | 11/2011 | Hebda et al. |
| 8,128,764 | B2 | 3/2012 | Miracle et al. |
| 8,211,548 | B2 | 7/2012 | Chun et al. |
| 8,316,687 | B2 | 11/2012 | Slattery |
| 8,336,359 | B2 | 12/2012 | Werz |
| 8,408,039 | B2 | 4/2013 | Cao et al. |
| 8,430,075 | B2 | 4/2013 | Qiao et al. |
| 8,454,765 | B2 | 6/2013 | Saller et al. |
| 8,499,605 | B2 | 8/2013 | Bryan |
| 8,551,264 | B2 | 10/2013 | Kosaka et al. |
| 8,568,540 | B2 | 10/2013 | Marquardt et al. |
| 8,578,748 | B2 | 11/2013 | Huskamp et al. |
| 8,597,442 | B2 | 12/2013 | Hebda et al. |
| 8,597,443 | B2 | 12/2013 | Hebda et al. |
| 8,608,913 | B2 | 12/2013 | Shim et al. |
| 8,679,269 | B2 | 3/2014 | Goller et al. |
| 8,919,168 | B2 | 12/2014 | Valiev et al. |
| 9,034,247 | B2 | 5/2015 | Suzuki et al. |
| 9,327,342 | B2 | 5/2016 | Oppenheimer et al. |
| 9,624,567 | B2 | 4/2017 | Bryan et al. |
| 9,732,408 | B2 | 8/2017 | Sanz et al. |
| 9,765,420 | B2 | 9/2017 | Bryan |
| 2002/0033717 | A1 | 3/2002 | Matsuo |
| 2003/0168138 | A1 | 9/2003 | Marquardt |
| 2004/0099350 | A1 | 5/2004 | Manitone et al. |
| 2004/0148997 | A1 | 8/2004 | Amino et al. |
| 2004/0221929 | A1 | 11/2004 | Hebda et al. |
| 2004/0250932 | A1 | 12/2004 | Briggs |
| 2005/0047952 | A1 | 3/2005 | Coleman |
| 2005/0145310 | A1 | 7/2005 | Bewlay et al. |
| 2006/0045789 | A1 | 3/2006 | Nasserrafi et al. |
| 2006/0110614 | A1 | 5/2006 | Liimatainen |
| 2006/0243356 | A1 | 11/2006 | Oikawa et al. |
| 2007/0017273 | A1 | 1/2007 | Haug et al. |
| 2007/0098588 | A1 | 5/2007 | Narita et al. |
| 2007/0193662 | A1 | 8/2007 | Jablokov et al. |
| 2007/0286761 | A1 | 12/2007 | Miracle et al. |
| 2008/0000554 | A1 | 1/2008 | Yaguchi et al. |
| 2008/0103543 | A1 | 5/2008 | Li et al. |
| 2008/0107559 | A1 | 5/2008 | Nishiyama et al. |
| 2008/0202189 | A1 | 8/2008 | Otaki |
| 2008/0210345 | A1 | 9/2008 | Tetyukhin et al. |
| 2008/0264932 | A1 | 10/2008 | Hirota |
| 2009/0000706 | A1 | 1/2009 | Huron et al. |
| 2009/0183804 | A1 | 7/2009 | Zhao et al. |
| 2009/0234385 | A1 | 9/2009 | Cichocki et al. |
| 2010/0307647 | A1 | 12/2010 | Marquardt et al. |
| 2011/0038751 | A1 | 2/2011 | Marquardt et al. |
| 2011/0180188 | A1 | 7/2011 | Bryan et al. |
| 2011/0183151 | A1 | 7/2011 | Yokoyama et al. |
| 2012/0003118 | A1 | 1/2012 | Hebda et al. |
| 2012/0012233 | A1 | 1/2012 | Bryan |
| 2012/0060981 | A1 | 3/2012 | Forbes Jones et al. |
| 2012/0067100 | A1 | 3/2012 | Stefansson et al. |
| 2012/0076611 | A1 | 3/2012 | Bryan |
| 2012/0076686 | A1 | 3/2012 | Bryan |
| 2012/0177532 | A1 | 7/2012 | Hebda et al. |
| 2012/0279351 | A1 | 11/2012 | Gu et al. |
| 2012/0308428 | A1 | 12/2012 | Forbes Jones et al. |
| 2013/0062003 | A1 | 3/2013 | Shulkin et al. |
| 2013/0118653 | A1 | 5/2013 | Bryan et al. |
| 2013/0156628 | A1 | 6/2013 | Forbes Jones et al. |
| 2014/0060138 | A1 | 3/2014 | Hebda et al. |
| 2014/0076468 | A1 | 3/2014 | Marquardt et al. |
| 2014/0076471 | A1 | 3/2014 | Forbes Jones et al. |
| 2014/0116582 | A1 | 5/2014 | Forbes Jones et al. |
| 2014/0238552 | A1 | 8/2014 | Forbes Jones et al. |
| 2014/0255719 | A1 | 9/2014 | Forbes Jones et al. |
| 2014/0260492 | A1 | 9/2014 | Thomas et al. |
| 2014/0261922 | A1 | 9/2014 | Thomas et al. |
| 2015/0129093 | A1 | 5/2015 | Forbes Jones et al. |
| 2016/0122851 | A1 | 5/2016 | Jones et al. |
| 2016/0201165 | A1 | 7/2016 | Foltz, IV |
| 2017/0058387 | A1 | 3/2017 | Marquardt et al. |
| 2017/0146046 | A1 | 5/2017 | Foltz, IV |
| 2017/0218485 | A1 | 8/2017 | Jones et al. |
| 2017/0321313 | A1 | 11/2017 | Thomas et al. |
| 2017/0349977 | A1 | 12/2017 | Forbes Jones et al. |
| 2018/0016670 | A1 | 1/2018 | Bryan |
| 2018/0073092 | A1 | 3/2018 | Forbes Jones et al. |
| 2018/0195155 | A1 | 7/2018 | Bryan |

FOREIGN PATENT DOCUMENTS

| | | | |
|---|---|---|---|
| CN | 1194671 | A | 9/1998 |
| CN | 1403622 | | 3/2003 |
| CN | 1816641 | A | 8/2006 |
| CN | 101104898 | A | 1/2008 |
| CN | 101205593 | A | 6/2008 |
| CN | 101294264 | A | 10/2008 |
| CN | 101684530 | A | 3/2010 |
| CN | 101637789 | B | 6/2011 |
| CN | 102212716 | A | 10/2011 |
| CN | 102816953 | A | 12/2012 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1433863 | | 6/2004 |
| EP | 1471158 | A1 | 10/2004 |
| EP | 1605073 | A1 | 12/2005 |
| EP | 1612289 | A2 | 1/2006 |
| EP | 1375690 | B1 | 3/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |

(56) References Cited

FOREIGN PATENT DOCUMENTS

| | | | |
|---|---|---|---|
| EP | 1546429 | B1 | 6/2012 |
| FR | 2545104 | A1 | 11/1984 |
| GB | 847103 | | 9/1960 |
| GB | 1170997 | A | 11/1969 |
| GB | 1345048 | | 1/1974 |
| GB | 1433306 | | 4/1976 |
| GB | 2151260 | A | 7/1985 |
| GB | 2198144 | A | 6/1988 |
| GB | 2337762 | A | 12/1999 |
| JP | 55-113865 | A | 9/1980 |
| JP | 57-62820 | A | 4/1982 |
| JP | 57-62846 | A | 4/1982 |
| JP | S58-210158 | A | 12/1983 |
| JP | 60-046358 | | 3/1985 |
| JP | 60-100655 | A | 4/1985 |
| JP | S61-060871 | | 3/1986 |
| JP | S61-217564 | A | 9/1986 |
| JP | S61-270356 | A | 11/1986 |
| JP | 62-109956 | A | 5/1987 |
| JP | 62-127074 | A | 6/1987 |
| JP | 62-149859 | A | 7/1987 |
| JP | S62-227597 | A | 10/1987 |
| JP | S62-247023 | A | 10/1987 |
| JP | S63-49302 | A | 3/1988 |
| JP | S63-188426 | A | 8/1988 |
| JP | H01-272750 | A | 10/1989 |
| JP | 1-279736 | A | 11/1989 |
| JP | 2-205661 | A | 8/1990 |
| JP | 3-134124 | A | 6/1991 |
| JP | H03-138343 | A | 6/1991 |
| JP | H03-166350 | A | 7/1991 |
| JP | H03-264618 | A | 11/1991 |
| JP | H03-274238 | A | 12/1991 |
| JP | 4-74856 | A | 3/1992 |
| JP | 4-103737 | A | 4/1992 |
| JP | 4-143236 | A | 5/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | H05-293555 | A | 11/1993 |
| JP | H06-93389 | A | 4/1994 |
| JP | 8-300044 | A | 11/1996 |
| JP | 9-143650 | | 6/1997 |
| JP | 9-194969 | A | 7/1997 |
| JP | 9-215786 | A | 8/1997 |
| JP | H10-128459 | A | 5/1998 |
| JP | H10-306335 | A | 11/1998 |
| JP | H11-21642 | A | 1/1999 |
| JP | H11-309521 | A | 11/1999 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-69591 | A | 3/2002 |
| JP | 2002-146497 | A | 5/2002 |
| JP | 2003-55749 | A | 2/2003 |
| JP | 2003-74566 | A | 3/2003 |
| JP | 2003-285126 | A | 10/2003 |
| JP | 2003-334633 | A | 11/2003 |
| JP | 2004-131761 | | 4/2004 |
| JP | 2005-281855 | A | 10/2005 |
| JP | 2007-291488 | A | 11/2007 |
| JP | 2007-327118 | A | 12/2007 |
| JP | 2008-200730 | A | 9/2008 |
| JP | 2009-138218 | A | 6/2009 |
| JP | WO 2009/142228 | A1 | 11/2009 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| JP | 2015-54332 | A | 3/2015 |
| KR | 920004946 | | 6/1992 |
| KR | 10-2005-0087765 | A | 8/2005 |
| KR | 10-2009-0069647 | A | 7/2009 |
| RU | 2003417 | C1 | 11/1993 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2217260 | C1 | 11/2003 |
| RU | 2234998 | C1 | 8/2004 |
| RU | 2269584 | C1 | 2/2006 |
| RU | 2288967 | C1 | 12/2006 |
| RU | 2364660 | C1 | 8/2009 |
| RU | 2368695 | C1 | 9/2009 |
| RU | 2378410 | C1 | 1/2010 |
| RU | 2392348 | C2 | 6/2010 |
| RU | 2393936 | C1 | 7/2010 |
| RU | 2441089 | C1 | 1/2012 |
| SU | 534518 | A1 | 1/1977 |
| SU | 631234 | A | 11/1978 |
| SU | 1077328 | A | 5/1982 |
| SU | 1135798 | A1 | 1/1985 |
| SU | 1088397 | A1 | 2/1991 |
| UA | 38805 | A | 5/2001 |
| UA | 40862 | A | 8/2001 |
| UA | a200613448 | | 6/2008 |
| WO | WO 98/17386 | A1 | 4/1998 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2007/142379 | A1 | 12/2007 |
| WO | WO 2008/017257 | A1 | 2/2008 |
| WO | WO 2009/082498 | A1 | 7/2009 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

Donachie, Jr., M.J., "Titanium a Technical Guide" 1988, ASM, pp. 39 and 46-50.

"Altemp® A286 Iron-Base Superalloy (UNS Designation S66286)", Allegheny Ludlum Technical Data Blue Sheet, 1998, 8 pages.

"ATI 425® Alloy", Technical Data Sheet, Version 1, May 28, 2010, 5 pages.

"ATI 425®—MIL Alloy", Technical Data Sheet, Version 2, Aug. 16, 2010, 5 pages.

"SPS Titan™ Titanium Fasteners", SPS Technologies Aerospace Fasteners, 2003, 4 pages.

Standard Specification for Wrought Titanium-6Aluminum-4Vanadium Alloy for Surgical Implant Applications (UNS R56400), Designation: F 1472-99, ASTM 1999, pp. 1-4.

Two new α-β titanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.

Zeng et al., "Evaluation of Newly Developed Ti-555 High Strength Titanium Fasteners", 17th AeroMat Conference & Exposition, May 18, 2006, 2 pages.

Office Action dated Dec. 16, 2004 in U.S. Appl. No. 10/434,598.

Office Action dated Aug. 17, 2005 in U.S. Appl. No. 10/434,598.

Office Action dated Dec. 19, 2005 in U.S. Appl. No. 10/434,598.

Office Action dated Sep. 6, 2006 in U.S. Appl. No. 10/434,598.

Office Action dated Apr. 1, 2010 in U.S. Appl. No. 11/745,189.

Interview summary dated Jun. 3, 2010 in U.S. Appl. No. 11/745,189.

Interview summary dated Jun. 15, 2010 in U.S. Appl. No. 11/745,189.

Office Action dated Nov. 24, 2010 in U.S. Appl. No. 11/745,189.

(56) References Cited

OTHER PUBLICATIONS

"Allvac TiOsteum and TiOstalloy Beat Titanium Alloys", printed from www.allvac.com/allvac/pages/Titanium/TiOsteum.htm on Nov. 7, 2005.
"Datasheet: Timetal 21S", Alloy Digest, Advanced Materials and Processes (Sep. 1998), pp. 38-39.
"Heat Treating of Nonferrous Alloys: Heat Treating of Titanium and Titanium Alloys," Metals Handbook, ASM Handbooks Online (2002).
"Stryker Orthopaedics TMZF® Alloy (UNS R58120)", printed from www.allvac.com/allvac/pages/Titanium/UNSR58120.htm on Nov. 7, 2005.
"Technical Data Sheet: Allvac® Ti—15Mo Beta Titanium Alloy" (dated Jun. 16, 2004).
"ASTM Designation F1801-97 Standard Practice for Corrosion Fatigue Testing of Metallic Implant Materials" ASTM International (1997) pp. 876-880.
"ASTM Designation F2066-01 Standard Specification for Wrought Titanium-15 Molybdenum Alloy for Surgical Implant Applications (UMS R58150)," ASTM International (2000) pp. 1-4.
AL-6XN® Alloy (UNS N08367) Allegheny Ludlum Corporation, 2002, 56 pages.
Allegheny Ludlum, "High Performance Metals for Industry, High Strength, High Temperature, and Corrosion-Resistant Alloys", (2000) pp. 1-8.
Allvac, Product Specification for "Allvac Ti—15 Mo," available at http://www.allvac.com/allvac/pages/Titanium/Ti15MO.htm, last visited Jun. 9, 2003 p. 1 of 1.
ASM Materials Engineering Dictionary, J.R. Davis Ed., ASM International, Materials Park, OH (1992) p. 39.
ATI Datalloy 2 Alloy, Technical Data Sheet, ATI Allvac, Monroe, NC, SS-844, Version1, Sep. 17, 2010, 8 pages.
ATI 690 (UNS N06690) Nickel-Base, ATI Allvac, Oct. 5, 2010, 1 page.
Isothermal forging definition, ASM Materials Engineering Dictionary, J.R. Davis ed., Fifth Printing, Jan. 2006, ASM International, p. 238.
Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
ASTM Designation F 2066-01, "Standard Specification for Wrought Titanium-15 Molybdenum Alloy for Surgical Implant Applications (UNS R58150)" 7 pages.
ATI 6-2-4-2™ Alloy Technical Data Sheet, Version 1, Feb. 26, 2012, 4 pages.
ATI 6-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®—MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti—15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe-0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys—Cold Forming", ASM Handbook, 2006, ASM International, vol. 14B, 2 pages.
Bewlay, et al., "Superplastic roll forming of Ti alloys", Materials and Design, 21, 2000, pp. 287-295.
Bowen, A. W., "Omega Phase Embrittlement in Aged Ti—15% Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Desrayaud et al., "A novel high straining process for bulk materials—The development of a multipass forging system by compression along three axes", Journal of Materials Processing Technology, 172, 2006, pp. 152-158.
DiDomizio, et al., "Evaluation of a Ni—20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-S-D17.
Disegi, John, Wrought Titanium-15% Molybdenum Implant Material, Original Instruments and Implants of the Association for the Study of International Fixation—AO ASIF, (Oct. 2003).
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys—Solution Treating and Aging", ASM Handbook, 1991, ASM International, vol. 4, pp. 1-8.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.

(56) References Cited

OTHER PUBLICATIONS

Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Imperial Metal Industries Limited, Product Specification for "IMI Titanium 205", The Kynoch Press (England) pp. 1-5. (publication date unknown).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti—15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", WEAR, 249(1-2), 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications," Journal of ASTM International, vol. 2, Issue 9 (Oct. 2005) (published online Aug. 17, 2005).
Marquardt, Brian, "Characterization of Ti—15Mo for Orthopaedic Applications," TMS 2005 Annual Meeting: Technical Program, San Francisco, CA, (Feb. 13-17, 2005) Abstract, p. 239.
Marquardt, Brian, "Ti—15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., (Nov. 9-10, 2004) Abstract, p. 11.
Marte et al., "Structure and Properties of Ni—20Cr Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray JL, et al., Binary Alloy Phase Diagrams, Second Edition, vol. 1, Ed. Massalski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti—15Mo Alloy," Titanium '80 Science and Technology—Proceedings of the 4th International Conference on Titanium, H. Kimura & O. Izumi Eds. (May 19-22, 1980) pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Nutt, Michael J. et al., "The Application of Ti-15 Beta Titanium Alloy in High Strength Structural Orthopaedic Applications," Program and Abstracts for the Symposium on Titanium Niobium, Zirconium, and Tantalum for Medical and Surgical Applications, Washington, D.C., (Nov. 9-10, 2004) Abstract, p. 12.
Nyakana, et al., "Quick Reference Guide for β Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti—15Mo," Titanium '80 Science and Technology—Proceedings of the 4th International Conference on Titanium, H. Kimura & O. Izumi Eds. (May 19-22, 1980) pp. 1344-1350.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, (Nov. 2004) pp. 49-51.
Roach, M.D., et al., "Comparison of the Corrosion Fatigue Characteristics of CPTi-Grade 4, Ti—6A1—4V ELI, Ti—6A1—7 Nb, and Ti—15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti—6242S", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.

(56) References Cited

OTHER PUBLICATIONS

Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V—xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
TIMET 6-6-2 Titanium Alloy (Ti—6Al—6V—2Sn), Annealed, accessed Jun. 27, 2012.
TIMET TIMETAL® 6-2-4-2 (Ti—6Al—2Sn—4Zr—2Mo—0.08Si) Titanium Alloy datasheet, accessed Jun. 26, 2012.
TIMET TIMETAL® 6-2-4-6 Titanium Alloy (Ti—6Al—2Sn—4Zr—6Mo), Typical, accessed Jun. 26, 2012.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Zardiackas, L.D. et al., "Stress Corrosion Cracking Resistance of Titanium Implant Materials," Transactions of the 27th Annual Meeting of the Society for Biomaterials, (2001).
Zhang et al., "Simulation of slip band evolution in duplex Ti—6Al—4V", Acta Materialia, vol. 58, 2010, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Office Action dated Oct. 19, 2011 in U.S. Appl. No. 12/691,952.
Office Action dated Feb. 2, 2012 in U.S. Appl. No. 12/691,952.
Office Action dated Feb. 20, 2004 in U.S. Appl. No. 10/165,348.
Office Action dated Oct. 26, 2004 in U.S. Appl. No. 10/165,348.
Office Action dated Feb. 16, 2005 in U.S. Appl. No. 10/165,348.
Office Action dated Jul. 25, 2005 in U.S. Appl. No. 10/165,348.
Office Action dated Jan. 3, 2006 in U.S. Appl. No. 10/165,348.
Office Action dated Aug. 6, 2008 in U.S. Appl. No. 11/448,160.
Office Action dated Jan. 13, 2009 in U.S. Appl. No. 11/448,160.
Notice of Allowance dated Apr. 13, 2010 in U.S. Appl. No. 11/448,160.
Notice of Allowance dated Sep. 20, 2010 in U.S. Appl. No. 11/448,160.
Office Action dated Sep. 26, 2007 in U.S. Appl. No. 11/057,614.
Office Action dated Jan. 10, 2008 in U.S. Appl. No. 11/057,614.
Office Action dated Aug. 29, 2008 in U.S. Appl. No. 11/057,614.
Office Action dated Aug. 11, 2009 in U.S. Appl. No. 11/057,614.
Office Action dated Jan. 14, 2010 in U.S. Appl. No. 11/057,614.
Interview summary dated Apr. 14, 2010 in U.S. Appl. No. 11/057,614.
Office Action dated Jun. 21, 2010 in U.S. Appl. No. 11/057,614.
Notice of Allowance dated Sep. 3, 2010 in U.S. Appl. No. 11/057,614.
Interview summary dated Jan. 6, 2011 in U.S. Appl. No. 11/745,189.
Notice of Allowance dated Jun. 27, 2011 in U.S. Appl. No. 11/745,189.
Office Action dated Jan. 11, 2011 in U.S. Appl. No. 12/911,947.
Office Action dated Aug. 4, 2011 in U.S. Appl. No. 12/911,947.
Office Action dated Nov. 16, 2011 in U.S. Appl. No. 12/911,947.
Advisory Action dated Jan. 25, 2012 in U.S. Appl. No. 12/911,947.
Notice of Panel Decision from Pre-Appeal Brief Review mailed Mar. 28, 2012 in U.S. Appl. No. 12/911,947.
Office Action dated Apr. 5, 2012 in U.S. Appl. No. 12/911,947.
Office Action dated Sep. 19, 2012 in U.S. Appl. No. 12/911,947.
Advisory Action dated Nov. 29, 2012 in U.S. Appl. No. 12/911,947.
Office Action dated May 31, 2013 in U.S. Appl. No. 12/911,947.
Office Action dated Jan. 3, 2011 in U.S. Appl. No. 12/857,789.
Office Action dated Jul. 27, 2011 in U.S. Appl. No. 12/857,789.
Advisory Action dated Oct. 7, 2011 in U.S. Appl. No. 12/857,789.
Notice of Allowance dated Jul. 1, 2013 in U.S. Appl. No. 12/857,789.
Office Action dated Nov. 14, 2012 in U.S. Appl. No. 12/885,620.
Office Action dated Jun. 13, 2013 in U.S. Appl. No. 12/885,620.
Office Action dated Nov. 14, 2012 in U.S. Appl. No. 12/888,699.
Office Action dated Oct. 3, 2012 in U.S. Appl. No. 12/838,674.
Office Action dated Jul. 18, 2013 in U.S. Appl. No. 12/838,674.
Office Action dated Sep. 26, 2012 in U.S. Appl. No. 12/845,122.
Notice of Allowance dated Apr. 17, 2013 in U.S. Appl. No. 12/845,122.
Office Action dated Dec. 24, 2012 in U.S. Appl. No. 13/230,046.
Notice of Allowance dated Jul. 31, 2013 in U.S. Appl. No. 13/230,046.
Office Action dated Dec. 26, 2012 in U.S. Appl. No. 13/230,143.
Notice of Allowance dated Aug. 2, 2013 in U.S. Appl. No. 13/230,143.
Office Action dated Mar. 25, 2013 in U.S. Appl. No. 13/108,045.
Office Action dated Apr. 16, 2013 in U.S. Appl. No. 13/150,494.
Office Action dated Jun. 14, 2013 in U.S. Appl. No. 13/150,494.
U.S. Appl. No. 13/777,066, filed Feb. 26, 2013.
U.S. Appl. No. 13/331,135, filed Dec. 20, 2011.
U.S. Appl. No. 13/792,285, filed Mar. 11, 2013.
U.S. Appl. No. 13/844,196, filed Mar. 15, 2013.
U.S. Appl. No. 13/844,545, filed Mar. 15, 2013.
Office Action dated Jan. 23, 2013 in U.S. Appl. No. 12/882,538.
Office Action dated Feb. 8, 2013 in U.S. Appl. No. 12/882,538.
Notice of Allowance dated Jun. 24, 2013 in U.S. Appl. No. 12/882,538.
U.S. Appl. No. 13/933,222, filed Mar. 15, 2013.
Beal et al., "Forming of Titanium and Titanium Alloys-Cold Forming", ASM Handbook, 2006, ASM International, Revised by ASM Committee on Forming Titanium Alloys, vol. 14B, 2 pages.

(56) References Cited

OTHER PUBLICATIONS

ASTM Designation F 2066/F2066M-13, "Standard Specification for Wrought Titanium-15 Molybdenum Alloy for Surgical Implant Applications (UNS R58150)", Nov. 2013, 6 pages.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Notice of Allowance dated Oct. 4, 2013 in U.S. Appl. No. 12/911,947.
Office Action dated Nov. 19, 2013 in U.S. Appl. No. 12/885,620.
Advisory Action Before the Filing of an Appeal Brief dated Jan. 30, 2014 in U.S. Appl. No. 12/885,620.
Office Action dated Jan. 17, 2014 in U.S. Appl. No. 13/108,045.
Notice of Allowance dated Nov. 5, 2013 in U.S. Appl. No. 13/150,494.
Supplemental Notice of Allowability dated Jan. 17, 2014 in U.S. Appl. No. 13/150,494.
Office Action dated Sep. 6, 2013 in U.S. Appl. No. 13/933,222.
Notice of Allowance dated Oct. 1, 2013 in U.S. Appl. No. 13/933,222.
Notice of Allowance dated May 6, 2014 in U.S. Appl. No. 13/933,222.
U.S. Appl. No. 14/077,699, filed Nov. 12, 2013.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
Hsieh, Chih-Chun and Weite Wu, "Overview of Intermetallic Sigma Phase Precipitation in Stainless Steels", ISRN Metallurgy, vol. 2012, 2012, pp. 1-16.
Office Action dated Dec. 23, 2014 in U.S. Appl. No. 12/691,952.
Office Action dated Nov. 28, 2014 in U.S. Appl. No. 12/885,620.
Office Action dated Jan. 21, 2015 in U.S. Appl. No. 13/792,285.
Notice of Allowance dated Oct. 24, 2014 in U.S. Appl. No. 13/844,545.
Notice of Allowance dated Feb. 6, 2015 in U.S. Appl. No. 13/844,545.
ASM Materials Engineering Dictionary, "Blasting or Blast Cleaning," J.R. Davis Ed., ASM International, Materials Park, OH (1992) p. 42.
ATI 38-644™ Beta Titanium Alloy Technical Data Sheet, UNS R58640, Version 1, Dec. 21, 2011, 4 pages.
ATI 425® Alloy, Grade 38, Titanium Alloy, UNS R54250, Technical Data Sheet, Version 1, Nov. 25, 2013, pp. 1-6.
Beal et al., "Forming of Titanium and Titanium Alloys—Cold Forming", ASM Handbook, 2006, vol. 14B, pp. 656-669.
Craighead et al., "Ternary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Diderrich et al., "Addition of Cobalt to the Ti—6Al—4V Alloy", Journal of Metals, May 1968, pp. 29-37.
Donachie Jr., M.J., "Heat Treating Titanium and its Alloys", Heat Treating Process, Jun./Jul. 2001, pp. 47-49, 52-53, and 56-57.
Glazunov et al., Structural Titanium Alloys, Moscow, Metallurgy, 1974, pp. 264-283.
Markovsky, P. E., "Preparation and properties of ultrafine (submicron) structure titanium alloys", Materials Science and Engineering, 1995, A203, 4 pages.
Novikov et al., 17.2.2 Deformable ($\alpha + \beta$) alloys, Chapter 17, Titanium and its Alloys, Metal Science, vol. II Thermal Treatment of the Alloy, Physical Matallurgy, 2009, pp. 357-360.
Swann, P.R. and J. G. Parr, "Phase Transformations in Titanium-Rich Alloys of Titanium and Cobalt", Transactions of the Metallurgical Society of AIME, Apr. 1958, pp. 276-279.
Ti—6Al—4V, Ti64, 6Al—4V, 6-4, UNS R56400, 1 page.
Titanium 3Al—8V—6Cr—4Mo—4Zr Beta-C/Grade 19 UNS R58640, 2 pages.
Yakymyshyn et al., "The Relationship between the Constitution and Mechanical Properties of Titanium-Rich Alloys of Titanium and Cobalt", 1961, vol. 53, pp. 283-294.
AFML-TR-76-80 Development of Titanium Alloy Casting Technology, Aug. 1976, 5 pages.
Valiev et al., "Nanostructured materiais produced by sever plastic deformation", Moscow, LOGOS, 2000.
Li et al., "The optimal determination of forging process parameters for Ti—6.5Al—3.5Mo—1.5Zr—0.3Si alloy with thick lamellar microstructure in two phase field based on P-map", Journal of Materials Processing Technology, vol. 210, Issue 2, Jan. 19, 2010, pp. 370-377.
Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.
Superaustenitic, http.//www.atimetals.com/products/Pages/superaustenitic.aspx, Nov. 9, 2015, 3 pages.
French, D., "Austenitic Stainless Steel", The National Board of Boiler and Pressure Vessel Inspectors Bulletin, 1992, 3 pages.
Acom Magazine, outokumpu, NACE International, Feb. 2013, 16 pages.
ATI A286™ Iron Based Superalloy (UNS S66286) Technical Data Sheet, Allegheny Technologies Incorporated, Version 1, Apr. 17, 2012, 9 pages.
ATI A286™ (UNS S66286) Technical Data Sheet, Allegheny Technologies Incorporated, Version 1, Mar. 14, 2012, 3 pages.
Corrosion-Resistant Titanium, Technical Data Sheet, Allegheny Technologies Incorporated, Version 1, Feb. 29, 2012, 5 pages.
ATI 3-2.5™ Titanium (Ti Grade 9) Technical Data Sheet, ATI Wah Chang, 2010, 4 pages.
Grade 9 Ti 3Al 2.5V Alloy (UNS R56320), Jul. 30, 2013, http://www.azom.com/article.aspx?ArticleID=9337, 3 pages.
ATI Ti—6Al—4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V—2Mo—2Fe Alloy, Jul. 9, 2013, http://www.azom.com/article.aspx?ArticleID=9448, 2 pages.

(56) References Cited

OTHER PUBLICATIONS

Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of TIMETAL® 54M", Henderson Technical Laboratory, Titanium Metals Corporation, ITA, Oct. 2010, Orlando, Florida, 18 pages.
ATI Datalloy HP™ Alloy, UNS N08830, Technical Data Sheet Version 1, Apr. 14, 2015, 6 pages.
ATI Datalloy 2® Alloy, Technical Data Sheet, Version 1, Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://www.azom.com/article.aspx?ArticleID=9305, Jun. 20, 2013, 4 pages.
Gammon et al., "Metallography and Microstructures of Titanium and its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials for Mechanical Engineering, vol. 35. No. 11, Nov. 2011, 5 pages. (English abstract included).
Srinivasan et al., "Rolling of Plates and Sheets from As-Cast Ti—6Al—4V—0.1 B", Journal of Materials Engineering and Performance, vol. 18.4, Jun. 2009, pp. 390-398.
Gil et al., "Formation of alpha-Widmanstatten structure: effects of grain size and cooling rate on the Widmanstatten morphologies and on the mechanical properties in Ti6Al4V alloy", Journal of Alloys and Compounds, 329, 2001, pp. 142-152.
Enayati et al., "Effects of temperature and effective strain on the flow behavior of Ti—6Al—4V", Journal of the Franklin Institute, 348, 2011, pp. 2813-2822.
Longxian et al., "Wear-Resistant Coating and Performance Titanium and Its Alloy, and properties thereof", Northeastern University Press, Dec. 2006, pp. 26-28, 33.
"Acceleration and Improvement for Heat Treating Workers," Quick Start and Improvement for Heat Treatment, ed. Yang Man, China Machine Press, Apr. 2008, pp. 265-266.
Office Action dated Apr. 23, 2015 in U.S. Appl. No. 12/691,952.
Office Action dated Jul. 28, 2015 in U.S. Appl. No. 12/691,952.
Office Action dated Feb. 17, 2016 in U.S. Appl. No. 12/691,952.
Office Action dated Jun. 28, 2016 in U.S. Appl. No. 12/691,952.
Applicant-Initiated Interview Summary dated Aug. 22, 2016 in U.S. Appl. No. 12/691,952.
Advisory Action Before the Filing of an Appeal Brief dated Aug. 30, 2016 in U.S. Appl. No. 12/691,952.
Office Action dated Apr. 28, 2017 in U.S. Appl. No. 12/691,952.
Office Action dated Jul. 10, 2017 in U.S. Appl. No. 12/691,952.
Advisory Action dated Aug. 7, 2017 in U.S. Appl. No. 12/691,952.
Advisory Action dated May 18, 2015 in U.S. Appl. No. 12/885,620.
Office Action dated Jun. 30, 2015 in U.S. Appl. No. 12/885,620.
Notice of Abandonment dated Jan. 29, 2016 in U.S. Appl. No. 12/885,620.
Office Action dated May 27, 2015 in U.S. Appl. No. 12/838,674.
Applicant Initiated Interview Summary dated Sep. 1, 2015 in U.S. Appl. No. 12/838,674.
Notice of Allowance dated Sep. 25, 2015 in U.S. Appl. No. 12/838,674.
Office Action dated Mar. 30, 2016 in U.S. Appl. No. 13/108,045.
Office Action dated Sep. 9, 2016 in U.S. Appl. No. 13/108,045.
Advisory Action dated Mar. 7, 2017 in U.S. Appl. No. 13/108,045.
Office Action dated Jun. 4, 2015 in U.S. Appl. No. 13/792,285.
Notice of Allowance dated Sep. 16, 2015 in U.S. Appl. No. 13/792,285.
Response to Rule 312 Communication dated Oct. 20, 2015 in U.S. Appl. No. 13/792,285.
Office Action dated Jun. 3, 2015 in U.S. Appl. No. 13/714,465.
Office Action dated Jul. 8, 2015 in U.S. Appl. No. 13/714,465.
Notice of Allowance dated Sep. 2, 2015 in U.S. Appl. No. 13/714,465.
Response to Rule 312 Communication dated Sep. 29, 2015 in U.S. Appl. No. 13/714,465.
Response to Rule 312 Communication dated Oct. 8, 2015 in U.S. Appl. No. 13/714,465.
Office Action dated Jun. 26, 2015 in U.S. Appl. No. 13/777,066.
Office Action dated Oct. 5, 2015 in U.S. Appl. No. 13/777,066.
Advisory Action Before the Filing of an Appeal Brief dated Mar. 17, 2016 in U.S. Appl. No. 13/777,066.
Office Action dated Jul. 22, 2016 in U.S. Appl. No. 13/777,066.
Office Action dated Oct. 12, 2016 in U.S. Appl. No. 13/777,066.
Office Action dated May 18, 2017 in U.S. Appl. No. 13/777,066.
Advisory Action Before the Filing of an Appeal Brief dated Jul. 10, 2017 in U.S. Appl. No. 13/777,066.
Notice of Allowance dated Aug. 30, 2017 in U.S. Appl. No. 13/777,066.
Corrected Notice of Allowability dated Dec. 20, 2017 in U.S. Appl. No. 13/777,066.
Office Action dated Aug. 19, 2015 in U.S. Appl. No. 13/844,196.
Office Action dated Oct. 15, 2015 in U.S. Appl. No. 13/844,196.
Office Action dated Feb. 12, 2016 in U.S. Appl. No. 13/844,196.
Advisory Action Before the Filing of an Appeal Brief dated Jun. 15, 2016 in U.S. Appl. No. 13/844,196.
Office Action dated Aug. 22, 2016 in U.S. Appl. No. 13/844,196.
Office Action dated Dec. 29, 2016 in U.S. Appl. No. 13/844,196.
Notice of Allowance dated Jul. 13, 2017 in U.S. Appl. No. 13/844,196.
Corrected Notice of Allowability dated Jul. 20, 2017 in U.S. Appl. No. 13/844,196.
Corrected Notice of Allowability dated Aug. 18, 2017 in U.S. Appl. No. 13/844,196.
Office Action dated Oct. 2, 2015 in U.S. Appl. No. 14/373,029.
Office Action dated Aug. 12, 2016 in U.S. Appl. No. 14/073,029.
Office Action dated Jun. 14, 2017 in U.S. Appl. No. 14/073,029.
Notice of Allowance dated Jul. 7, 2017 in U.S. Appl. No. 14/073,029.
Notice of Allowability dated Sep. 21, 2017 in U.S. Appl. No. 14/073,029.
Office Action dated Oct. 28, 2015 in U.S. Appl. No. 14/093,707.
Office Action dated Mar. 17, 2016 in U.S. Appl. No. 14/093,707.
Advisory Action Before the Filing of an Appeal Brief dated Jun. 10, 2016 in U.S. Appl. No. 14/093,707.
Office Action dated Sep. 30, 2016 in U.S. Appl. No. 14/093,707.
Notice of Allowance dated Jan. 13, 2017 in U.S. Appl. No. 14/093,707.
Supplemental Notice of Allowance dated Jan. 27, 2017 in U.S. Appl. No. 14/093,707.
Supplemental Notice of Allowance dated Feb. 10, 2017 in U.S. Appl. No. 14/093,707.
Supplemental Notice of Allowability dated Mar. 1, 2017 in U.S. Appl. No. 14/093,707.
Notice of Third-Party Submission mailed Dec. 16, 2015 in U.S. Appl. No. 14/077,699.
Office Action dated Jul. 25, 2016 in U.S. Appl. No. 14/077,699.
Office Action dated Aug. 16, 2016 in U.S. Appl. No. 14/077,699.
Office Action dated Oct. 25, 2016 in U.S. Appl. No. 14/077,699.
Advisory Action dated Nov. 30, 2016 in U.S. Appl. No. 14/077,699.
Office Action dated Dec. 1, 2017 in U.S. Appl. No. 14/077,699.
Office Action dated Mar. 16, 2016 in U.S. Appl. No. 15/005,281.
Office Action dated Aug. 26, 2016 in U.S. Appl. No. 15/005,281.
Notice of Panel Decision from Pre-Appeal Brief Review mailed Feb. 24, 2017 in U.S. Appl. No. 15/005,281.
Office Action dated Mar. 2, 2017 in U.S. Appl. No. 15/005,281.

(56) References Cited

OTHER PUBLICATIONS

Notice of Allowance dated May 10, 2017 in U.S. Appl. No. 15/005,281.
Corrected Notice of Allowability dated Aug. 9, 2017 in U.S. Appl. No. 15/005,281.
Office Action dated Apr. 5, 2016 in U.S. Appl. No. 14/028,588.
Office Action dated Aug. 8, 2016 in U.S. Appl. No. 14/028,588.
Advisory Action dated Oct. 14, 2016 in U.S. Appl. No. 14/028,588.
Applicant Initiated Interview Summary dated Oct. 27, 2016 in U.S. Appl. No. 14/028,588.
Office Action dated Mar. 15, 2017 in U.S. Appl. No. 14/028,588.
Office Action dated Jul. 14, 2017 in U.S. Appl. No. 14/028,588.
Advisory Action dated Sep. 12, 2017 in U.S. Appl. No. 14/028,588.
Notice of Panel Decision from Pre-Appeal Brief Review mailed Oct. 27, 2017 in U.S. Appl. No. 14/028,588.
Office Action dated Apr. 13, 2016 in U.S. Appl. No. 14/083,759.
Office Action dated May 6, 2016 in U.S. Appl. No. 14/083,759.
Notice of Allowance dated Oct. 13, 2016 in U.S. Appl. No. 14/083,759.
U.S. Appl. No. 15/348,140, filed Nov. 10, 2016.
Notice of Allowance dated Dec. 16, 2016 in U.S. Appl. No. 14/922,750.
Notice of Allowance dated Feb. 28, 2017 in U.S. Appl. No. 14/922,750.
Office Action dated Apr. 10, 2017 in U.S. Appl. No. 14/594,300.
Office Action dated May 25, 2017 in U.S. Appl. No. 14/594,300.
Office Action dated Sep. 13, 2017 in U.S. Appl. No. 14/594,300.
Advisory Action dated Jan. 26, 2018 in U.S. Appl. No. 14/594,300.
Office Action dated Oct. 31, 2017 in U.S. Appl. No. 15/653,985.
Office Action dated Dec. 6, 2017 in U.S. Appl. No. 14/948,941.
U.S. Appl. No. 15/816,128, filed Nov. 17, 2017.
Office Action dated Feb. 27, 2018 in U.S. Appl. No. 13/108,045.
Notice of Allowance dated Feb. 9, 2018 in U.S. Appl. No. 14/028,588.
Office Action dated Feb. 28, 2018 in U.S. Appl. No. 14/594,300.
Office Action dated Feb. 15, 2018 in U.S. Appl. No. 14/948,941.
Notice of Allowance dated Jun. 6, 2018 in U.S. Appl. No. 12/691,952.
Interview Summary dated Mar. 12, 2018 in U.S. Appl. No. 14/077,699.
Notice of Allowance dated Jun. 29, 2018 in U.S. Appl. No. 14/594,300.
Office Action dated Mar. 16, 2018 in U.S. Appl. No. 15/653,985.
Office Action dated Apr. 2, 2018 in U.S. Appl. No. 14/881,633.
Notice of Allowance dated Jun. 22, 2018 in U.S. Appl. No. 15/433,443.
Forging Machinery, Dies, Processes, Metals Handbook Desk Edition, ASM International, Published: 1998, pp. 839-863.
Smith, et al. "Types of Heat-Treating Furnaces," Heat Treating, ASM Handbook, ASM International, 1991, vol. 4, p. 465-474.
Concise Explanation for Third Party Preissuance submission under Rule 1.290 filed in U.S. Appl. No. 15/678,527 on Jun. 5, 2018.
Guidelines for PWR Steam Generator Tubing Specifications and Repair, Electric Power Research Institute, Apr. 14, 1999, vol. 2, Revision 1, 74 pages. (accessed at https://www.epri.com/#/pages/product/TR-016743-V2R1/).
Materials Reliability Program: Guidelines for Thermally Treated Alloy 690 Pressure Vessel Nozzels, (MRP-241), Electric Power Research Institute, Jul. 25, 2008, 51 pages. (accessed at https://www.epri.com/#/pages/product/1015007/).
Microstructure Etching and Carbon Analysis Techniques, Electric Power Research Institute, May 1, 1990, 355 pages. (accessed at https://www.epri.com/#/pages/product/NP-6720-SD/).
Frodigh, John, "Some Factors Affecting the Appearance of the Microstructure in Alloy 690", Proceedings of the Eighth International Symposium on Environmental Degradation of Materials in Nuclear Power Systems—Water Reactors, American Nuclear Society, Inc., vol. 1, Aug. 10, 1997, 12 pages.
Kajimura et al., "Corrosion Resistance of TT Alloy 690 Manufactured by Various Melting Processes in High Temperature NaOH Solution", Proceedings of the Eighth International Symposium on Environmental Degradation of Materials in Nuclear Power Systems—Water Reactors, American Nuclear Society, Inc., vol. 1, Aug. 10, 1997, pp. 149-156.
Notice of Allowability dated Jul. 20, 2018 in U.S. Appl. No. 12/691,952.
Office Action dated Jul. 17, 2018 in U.S. Appl. No. 14/077,699.
Notice of Allowance dated Sep. 6, 2018 in U.S. Appl. No. 14/028,588.
Corrected Notice of Allowability dated Jul. 9, 2018 in U.S. Appl. No. 14/594,300.
Notice of Allowance dated Aug. 15, 2018 in U.S. Appl. No. 15/653,985.
Office Action dated Jul. 30, 2018 in U.S. Appl. No. 14/948,941.
Office Action dated Aug. 6, 2018 in U.S. Appl. No. 14/881,633.
Notice of Allowability dated Aug. 27, 2018 in U.S. Appl. No. 15/433,443.
Office Action dated Aug. 28, 2018 in U.S. Appl. No. 15/678,527.
U.S. Appl. No. 16/122,174, filed Sep. 5, 2018.
U.S. Appl. No. 16/122,450, filed Sep. 5, 2018.
The Japan Society for Heat Treatment, Introduction of Heat Treatment, Japan, Minoru, Kanai, Jan. 10, 1974, p. 150.
Office Action dated Nov. 2, 2018 in U.S. Appl. No. 13/108,045.
Office Action dated Jan. 10, 2019 in U.S. Appl. No. 14/077,699.
Notification of Reopening Prosecution mailed Dec. 19, 2018 in U.S. Appl. No. 14/028,588.
Office Action dated Feb. 1, 2019 in U.S. Appl. No. 14/028,588.
Applicant Initiated Interview Summary dated Jan. 30, 2019 in U.S. Appl. No. 14/948,941.
Office Action dated Feb. 15, 2019 in U.S. Appl. No. 14/948,941.
Notice of Allowance dated Apr. 1, 2019 in U.S. Appl. No. 14/881,633.
Corrected Notice of Allowability dated Sep. 6, 2018 in U.S. Appl. No. 15/433,443.
Notice of Allowability dated Oct. 11, 2018 in U.S. Appl. No. 15/433,443.
Corrected Notice of Allowability dated Oct. 18, 2018 in U.S. Appl. No. 15/433,443.
Notice of Allowance dated Dec. 13, 2018 in U.S. Appl. No. 15/678,527.
Corrected Notice of Allowability dated Apr. 15, 2019 in U.S. Appl. No. 15/678,527.
Office Action dated Jan. 10, 2019 in U.S. Appl. No. 15/659,661.
Office Action dated Jan. 25, 2019 in U.S. Appl. No. 15/348,140.
Office Action dated Mar. 8, 2019 in U.S. Appl. No. 15/816,128.
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Office Action dated Jun. 18, 2014 in U.S. Appl. No. 12/885,620.
Angeliu et al. "Behavior of Grain Boundary Chemistry and Precipitates upon Thermal Treatment of Controlled Purity Alloy 690", Metallurgical Transactions A, vol. 21A, Aug. 1990, pp. 2097-2107.
Park et al., "Effect of heat treatment on fatigue crack growth rate of Inconel 690 and Inconel 600", Journal of Nuclear Materials, 231, 1996, pp. 204-212.

* cited by examiner

HIGH STRENGTH ALPHA/BETA TITANIUM ALLOY FASTENERS AND FASTENER STOCK

CROSS-REFERENCE TO RELATED APPLICATIONS

The present application is a continuation-in-part application claiming priority under 35 U.S.C. § 120 from co-pending U.S. patent application Ser. No. 12/888,699, filed on Sep. 23, 2010, and entitled "High Strength Alpha/Beta Titanium Alloy Fasteners and Fastener Stock", the entire disclosure of which is incorporated by reference herein.

BACKGROUND OF THE TECHNOLOGY

Field of the Technology

The present disclosure relates to mechanical fasteners and fastener stock, and in particular to fasteners and fastener stock comprising alpha/beta titanium alloys.

Description of the Background of the Technology

Titanium alloys typically exhibit a high strength-to-weight ratio, are corrosion resistant, and are resistant to creep at moderately high temperatures. For these reasons, titanium alloys are used in aerospace and aeronautic applications including, for example, landing gear members, engine frames, and mechanical fasteners.

Reducing the weight of an aircraft results in fuel savings, and thus there is a strong drive in the aerospace industry to reduce aircraft weight. Titanium and titanium alloys are attractive materials for achieving weight reduction in aircraft applications because of their high strength-to-weight ratio. Currently, titanium alloy fasteners are used in less demanding aerospace applications. In certain aerospace applications in which titanium alloys do not exhibit sufficient strength to meet the particular mechanical requirements of the application, heavier iron and nickel based alloy fasteners are used.

Most titanium alloy parts used in aerospace applications are made from Ti-6Al-4V alloy (ASTM Grade 5; UNS R56400; AMS 4965), which is an alpha/beta titanium alloy. Typical minimum specification for small diameter Ti-6Al-4V fastener stock, i.e., fastener stock having a diameter less than 0.5 inches (1.27 cm), are 170 ksi (1,172 MPa) ultimate tensile strength (UTS), as determined according to ASTM E8/E8M-09 ("Standard Test Methods for Tension Testing of Metallic Materials" ASTM International, 2009), and 103 ksi (710 MPa) double shear strength (DSS), as determined according to NASM 1312-13 ("Method 13-Double Shear", Aerospace Industries Association—National Aerospace Standard (Metric), Feb. 1, 2003).

Iron and nickel based superalloys, such as, for example, A286 iron-base superalloy (UNS S66286), are representative of materials used in aerospace fastener applications having the next tier of strength. Typical specified minimum strengths for cold drawn and aged A286 alloy fasteners are 180 ksi (1,241 MPa) UTS and 108 ksi (744 MPa) DSS.

Alloy 718 nickel based superalloy (N07718) is a material used in aerospace fasteners that represents the uppermost tier of strength. Typical specification minimums for cold drawn and aged Alloy 718 superalloy fasteners are 220 ksi (1,517 MPa) UTS and 120 ksi (827 MPa) DSS.

In addition, two beta titanium alloys that currently are in use or are under consideration for use as high strength fastener materials exhibit minimum ultimate tensile strength of 180 ksi (1,241.1 MPa) and minimum DSS of 108 ksi (744.6 MPa). SPS Technologies, Jenkintown, Pa., offers a titanium alloy fastener fabricated from an optimized beta-titanium alloy that conforms to the chemistry of Ti-3Al-8V-6Cr-4Zr-4Mo titanium alloy (AMS 4958). The SPS bolts are available in diameters up to 1 inch (2.54 cm). Alcoa Fastening Systems (AFS) has developed a high-strength titanium fastener made from a titanium alloy that conforms to the nominal chemistry of Ti-5Al-5Mo-5V-3Cr-0.5Fe titanium alloy (also referred to as Ti-5553; UNS unassigned), a near beta-titanium alloy. The AFS Ti-5553 alloy fasteners reportedly exhibit tensile strength of 190 ksi (1,309 MPa), greater than 10% elongation, and minimum DSS of 113 ksi (779 MPa) for uncoated parts and 108 ksi (744 MPa) for coated parts.

Beta-titanium alloys generally include a high alloying content, which increases the cost of components and processing compared with alpha/beta titanium alloys. Beta-titanium alloys also generally have a higher density than alpha/beta titanium alloys. For example ATI 425® alpha/beta titanium alloy has a density of about 0.161 lbs/in$^3$ (4.5 g/cm$^3$), whereas the beta-titanium alloy Ti-3Al-8V-6Cr-4Zr-4Mo has a density of about 0.174 lbs/in$^3$ (4.8 g/cm$^3$), and the near beta-titanium alloy Ti-5Al-5Mo-5V-3Cr-0.5Fe has a density of about 0.168 lbs/in$^3$ (4.7 g/cm$^3$). Fasteners made from titanium alloys that are less dense may provide further weight savings for aerospace applications. In addition, the bimodal microstructure that is obtained, for example, in solution treated and aged alpha/beta titanium alloys may provide improved mechanical properties such as high cycle fatigue compared to beta-titanium alloys. Alpha/beta titanium alloys also have a higher beta transus temperature ($T_\beta$) than beta-titanium alloys. For example, the $T_\beta$ of ATI 425® alpha/beta titanium alloy is about 1,800° F. (982.2° C.), whereas Ti-5Al-5Mo-5V-3Cr-0.5Fe beta titanium alloy has a $T_\beta$ of about 1,500° F. (815.6° C.). The difference in $T_\beta$ for the two forms of titanium alloys allows for a larger temperature window for thermomechanical processing and heat treatment in the alpha/beta phase field for alpha/beta titanium alloys.

Given the continuing need for reduced fuel consumption through aircraft weight reduction, a need exists for improved lightweight fasteners for aerospace applications. In particular, it would be advantageous to provide lightweight alpha/beta titanium alloy aerospace fasteners and fastener stock exhibiting higher strength than current generation aerospace fasteners fabricated from Ti-6Al-4V alpha/beta titanium alloy.

SUMMARY

In a non-limiting embodiment according to the present disclosure, an article of manufacture selected from a titanium alloy fastener and a titanium alloy fastener stock includes an alpha/beta titanium alloy comprising, in percent by weight: 3.9 to 4.5 aluminum; 2.2 to 3.0 vanadium; 1.2 to 1.8 iron; 0.24 to 0.3 oxygen; up to 0.08 carbon; up to 0.05 nitrogen; titanium; and up to a total of 0.3 of other elements. In a non-limiting embodiment, the alpha/beta titanium alloy fastener or fastener stock exhibits an ultimate tensile strength of at least 170 ksi (1,172 MPa) and a double shear strength of at least 103 ksi (710.2 MPa).

In an additional non-limiting embodiment according to the present disclosure, an article of manufacture selected from a titanium alloy fastener and a titanium alloy fastener stock comprises an alpha/beta titanium alloy consisting essentially of, in percent by weight: 3.9 to 4.5 aluminum; 2.2 to 3.0 vanadium; 1.2 to 1.8 iron; 0.24 to 0.3 oxygen; up to 0.08 carbon; up to 0.05 nitrogen; up to a total of 0.3 of other elements; titanium; incidental impurities; and wherein the other elements consist essentially of one or more of tin, zirconium, molybdenum, chromium, nickel, silicon, copper, niobium, tantalum, manganese, and cobalt, wherein the weight percent of each such element is 0.1 or less, and boron and yttrium, wherein the weight percent of each such element is less than 0.005. In a non-limiting embodiment, the alpha/beta titanium alloy fastener or fastener stock exhibits an ultimate tensile strength of at least 170 ksi (1,172 MPa) and a double shear strength of at least 103 ksi (710.2 MPa).

In another non-limiting embodiment according to the present disclosure, a method for producing a titanium alloy fastener stock includes providing an alpha/beta titanium alloy comprising, in percent by weight: 3.9 to 4.5 aluminum; 2.2 to 3.0 vanadium; 1.2 to 1.8 iron; 0.24 to 0.3 oxygen; up to 0.08 carbon; up to 0.05 nitrogen; titanium; and up to a total of 0.3 of other elements. The alpha/beta titanium alloy is hot rolled and, subsequently, is annealed at an annealing temperature in a range of 1,200° F. (648.9° C.) to 1,400° F. (760° C.) for an annealing time in a range of 1 hour to 2 hours. After annealing, the alpha/beta titanium alloy is air cooled, and then machined to predetermined dimensions. The alpha/beta titanium alloy is then solution treated at a solution treatment temperature in a range of 1,500° F. (815.6° C.) to 1,700° F. (926.7° C.) for a solution treating time in a range of 0.5 hours to 2 hours. After solution treatment, the alpha/beta titanium alloy is cooled at a cooling rate that is at least as fast as air cooling, and then aged at an aging treatment temperature in a range of 800° F. (426.7° C.) to 1,000° F. (537.8° C.) for an aging time in a range of 4 hours to 16 hours. Following aging, the titanium alloy is air cooled. In a non-limiting embodiment, an alpha/beta titanium alloy made according to the foregoing method embodiment exhibits an ultimate tensile strength of at least 170 ksi (1,172 MPa) and a double shear strength of at least 103 ksi (710.2 MPa).

BRIEF DESCRIPTION OF THE DRAWINGS

The features and advantages of methods described herein may be better understood by reference to the accompanying drawings in which.

The reader will appreciate the foregoing details, as well as others, upon considering the following detailed description of certain non-limiting embodiments of methods according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the materials and by the methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Figure 1:
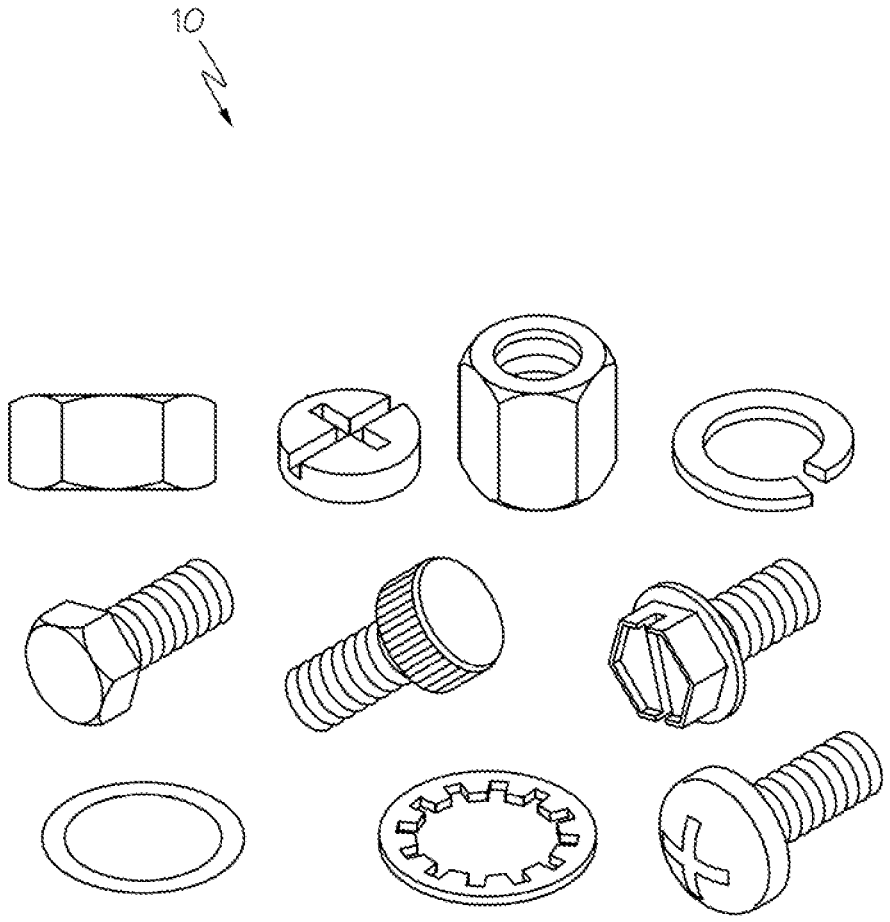
FIG. 1 is schematic representation of non-limiting embodiments of fasteners according to the present disclosure.

Referring now to FIG. 1, an aspect of this disclosure is directed to an article of manufacture selected from a titanium alloy fastener 10 and a titanium alloy fastener stock (not shown). In a non-limiting embodiment, the article includes an alpha/beta titanium alloy comprising, in percent by weight: 3.9 to 4.5 aluminum; 2.2 to 3.0 vanadium; 1.2 to 1.8 iron; 0.24 to 0.3 oxygen; up to 0.08 carbon; up to 0.05 nitrogen; titanium; and up to a total of 0.3 of other elements. In non-limiting embodiments of this disclosure the other elements referred to in the alloy composition comprise or consist essentially of one or more of tin, zirconium, molybdenum, chromium, nickel, silicon, copper, niobium, tantalum, manganese, and cobalt, each having a maximum concentration of 0.1 weight percent as individual elements, and boron and yttrium, each having a maximum concentration of 0.005% as individual elements, with the sum total of all of the other elements not exceeding 0.3 weight percent. In a non-limiting embodiment, the alpha/beta titanium article of manufacture according to the present disclosure exhibits an ultimate tensile strength of at least 170 ksi (1,172 MPa) and a double shear strength (DSS) of at least 103 ksi (710.2 MPa) for fasteners having diameters in the range of 0.18 inches (4.57 mm) to 1.25 inches (31.8 mm). In a non-limiting embodiment of this disclosure, fasteners may have diameters as small as can be fabricated. In a non-limiting embodiment, fasteners according to the present disclosure exhibit a percent elongation of at least 10%.

In certain non-limiting embodiments, the elemental composition of an alpha/beta titanium alloy included in the fastener or fastener stock according to the present disclosure is encompassed by the alloy composition disclosed in U.S. Pat. No. 5,980,655 ("the '655 patent"), which is incorporated by reference herein in its entirety. The '655 patent discloses an alloy having the composition shown in the following Table 1.

TABLE 1

| Alloying Element | Percent by Weight |
|---|---|
| Aluminum | from about 2.9 to about 5.0 |
| Vanadium | from about 2.0 to about 3.0 |
| Iron | from about 0.4 to about 2.0 |
| Oxygen | greater than 0.2 to about 0.3 |
| Carbon | from about 0.005 to about 0.03 |
| Nitrogen | from about 0.001 to about 0.02 |
| Other elements | less than about 0.5 |

A commercial version of the alloy of the '655 patent is ATI 425® alloy, which is available from ATI Aerospace, a business of Allegheny Technologies Incorporated, Pittsburgh, Pa. The ultimate tensile strength of alloys having the elemental composition disclosed in the '655 patent ranges from about 130 to 133 ksi (896 to 917 MPa). However, the present inventor surprisingly discovered that the significantly narrower range of chemistry in the present disclosure results in alpha/beta titanium fasteners that may exhibit the significantly higher ultimate tensile strengths disclosed herein. In a non-limiting embodiment, the ultimate tensile strength of the fasteners disclosed herein, made from the alloy composition disclosed herein, was up to 22% greater than the UTS disclosed in the '655 patent. Without intending to be bound by any theory of operation, it is believed that the surprisingly high strength of fastener alloy compositions disclosed herein may have been at least in part a result of significantly increasing the aluminum and oxygen levels above minimum levels disclosed in the '655 patent, which may have increased the strength of the dominant alpha phase in the alpha/beta titanium alloy.

The inventor also surprisingly discovered that narrowing the allowable ranges of aluminum, vanadium, iron, oxygen, carbon, and nitrogen in the fastener alloy disclosed herein relative to the alloy disclosed in the '655 patent reduces the variability of the mechanical properties and the variability of the beta transus temperature of the fastener alloy disclosed herein. This reduced variability is important for process and microstructural optimization to achieve the superior mechanical properties disclosed herein.

In another non-limiting embodiment, a titanium alloy fastener and a titanium alloy fastener stock disclosed herein comprises a diameter of up to 0.75 inches (1.91 cm), and has an ultimate tensile strength of at least 180 ksi (1,241 MPa) and a double shear strength of at least 108 ksi (744.6 MPa). In a non-limiting embodiment, fasteners or fastener stock according to this disclosure have up to about 26% greater ultimate tensile strength than the ultimate tensile strength disclosed in the '655 patent.

Referring again to FIG. 1, according to another non-limiting aspect of this disclosure, an article of manufacture selected from a titanium alloy fastener 10 and a titanium alloy fastener stock (not shown) includes an alpha/beta titanium alloy consisting essentially of, in percent by weight: 3.9 to 4.5 aluminum; 2.2 to 3.0 vanadium; 1.2 to 1.8 iron; 0.24 to 0.3 oxygen; up to 0.08 carbon; up to 0.05 nitrogen; no more than a total of 0.3 of other elements; with the remainder titanium; and incidental impurities. In non-limiting embodiments of this disclosure the other elements referred to in the alloy composition comprise or consist essentially of one or more of tin, zirconium, molybdenum, chromium, nickel, silicon, copper, niobium, tantalum, manganese, and cobalt, wherein the weight percent of each such element is 0.1 or less, and boron and yttrium, wherein the weight percent of each such element is less than 0.005, with the sum total of all of the other elements not exceeding 0.3 weight percent. In a non-limiting embodiment, the article of manufacture has an ultimate tensile strength of at least 170 ksi (1,172 MPa) and a double shear strength of at least 103 ksi (710.2 MPa).

In a non-limiting embodiment, a titanium fastener and a titanium alloy fastener stock according to the present disclosure comprises a diameter of up to 0.75 inches (1.91 cm), an ultimate tensile strength of at least 180 ksi (1,241 MPa), and a double shear strength of at least 108 ksi (744.6 MPa).

As used herein, the term "fastener" refers to a hardware device that mechanically joins or affixes two or more objects together. A fastener includes, but is not limited to, a bolt, a nut, a stud, a screw, a rivet, a washer, and a lock washer. As used herein, the phrase "fastener stock" refers to an article that is processed to form one or more fasteners from the article.

Figure 2:
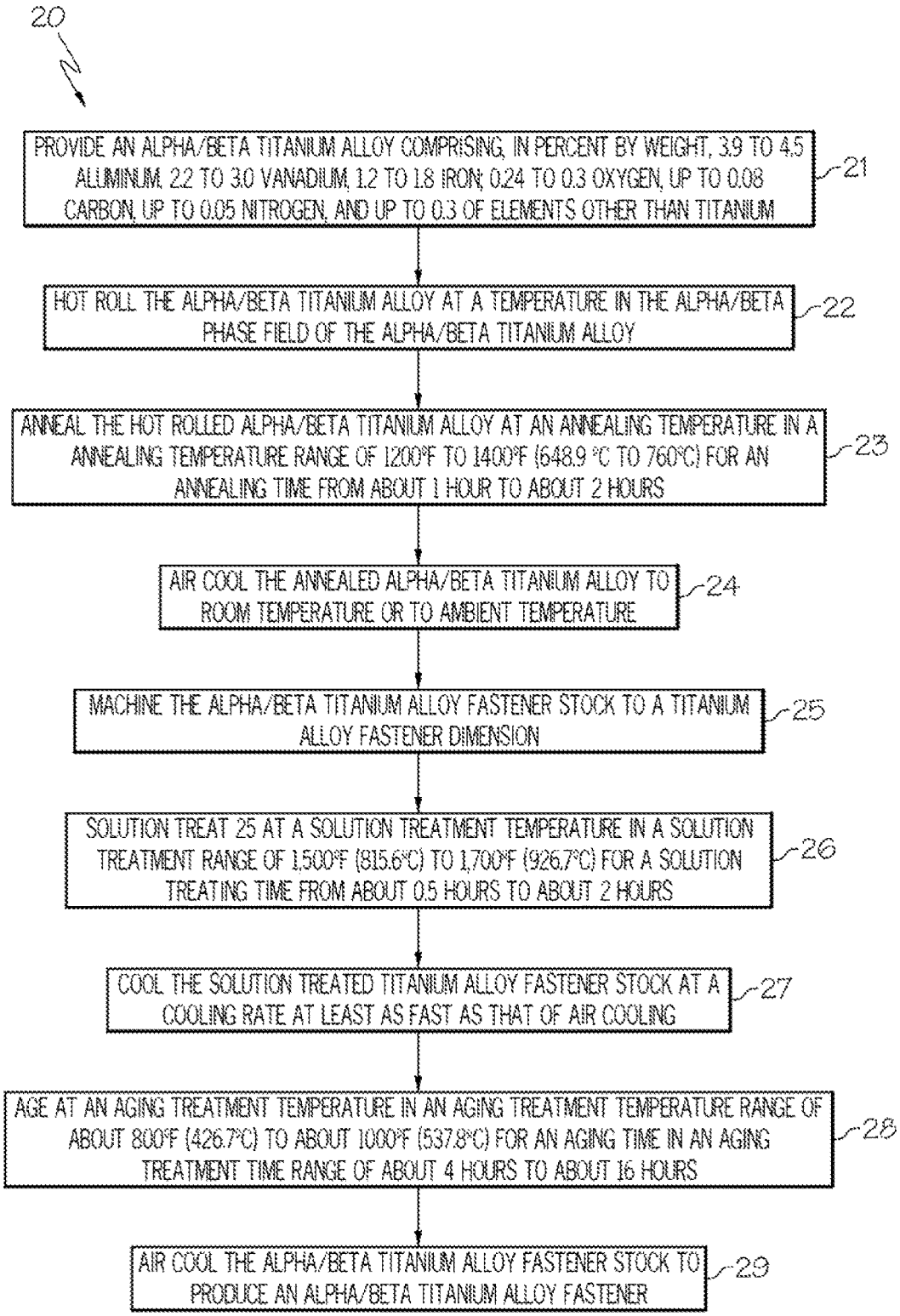
FIG. 2. is a flow diagram of a non-limiting embodiment of a method of producing fasteners and fastener stock according to the present disclosure.

Referring to FIG. 2, a non-limiting aspect according of the present disclosure is a method 20 for producing a titanium alloy fastener or fastener stock. The method comprises providing 21 an alpha/beta titanium alloy comprising, in percent by weight: 3.9 to 4.5 aluminum; 2.2 to 3.0 vanadium; 1.2 to 1.8 iron; 0.24 to 0.3 oxygen; up to 0.08 carbon; up to 0.05 nitrogen; titanium; and up to a total of 0.3 of other elements. In non-limiting embodiments of this disclosure the other elements referred to in the alloy composition comprise or consist essentially of one or more of tin, zirconium, molybdenum, chromium, nickel, silicon, copper, niobium, tantalum, manganese, and cobalt, wherein the weight percent of each such element is 0.1 or less, and boron and yttrium, wherein the weight percent of each such element is less than 0.005, with the sum total of all of the other elements not exceeding 0.3 weight percent. The alpha/beta titanium alloy is hot rolled 22 at a temperature in the alpha/beta phase field of the alpha/beta titanium alloy. In a non-limiting embodiment, a hot rolling temperature is at least 50° F. (27.8° C.) below the beta transus temperature of the alpha/beta titanium alloy, but no more that 600° F. (333.3° C.) below the beta transus temperature of the alpha/beta titanium alloy.

After hot rolling 22, the alpha/beta titanium alloy optionally is cold drawn and annealed to reduce size without substantially changing the mechanical properties of the alpha/beta titanium alloy. In a non-limiting embodiment, cold drawing reduces the cross-sectional area of the titanium alloy workpiece by less than 10%. Prior to cold drawing, the alpha/beta titanium alloy may be coated with a solid lubricant, such as, but not limited to, molybdenum disulfide ($MoS_2$).

In a non-limiting embodiment, after hot rolling 22, the alpha/beta titanium alloy is annealed 23 and cooled 24 to provide an alpha/beta titanium alloy fastener stock. In a non-limiting embodiment, annealing 23 includes annealing the hot rolled alpha/beta titanium alloy at an annealing temperature in an annealing temperature range of 1,200° F. to 1,400° F. (649° C. to 760° C.). In another non-limiting embodiment, an annealing time ranges from about 1 hour to about 2 hours. In still another non-limiting embodiment, annealing 23 comprises annealing the hot rolled alpha/beta titanium alloy at about 1,275° F. (690.6° C.) for about one hour. In a non-limiting embodiment, after annealing 23, the annealed alpha/beta titanium alloy is cooled 24 to room temperature or to ambient temperature. In certain non-limiting embodiments, after annealing 23, the annealed alpha/beta titanium alloy is air cooled or water cooled to room temperature or to ambient temperature.

After annealing 23 and cooling 24, in a non-limiting embodiment, the alpha/beta titanium alloy fastener stock is machined 25 to a dimension useful for forming a fastener from the stock. Optionally, a coating may be applied to the alpha/beta titanium alloy fastener stock prior to machining. Conventional machining coatings are known to persons skilled in the art and need not be elaborated upon herein.

In a non-limiting embodiment, the machined titanium alloy fastener stock is solution treated 26 at a solution treatment temperature in a solution treatment range of 1,500° F. (815.6° C.) to 1,700° F. (926.7° C.) for a solution treating time in a range of 0.5 hours to 2 hours. In a specific non-limiting embodiment, the machined titanium alloy fastener stock is solution treated 26 at a solution treatment temperature of about 1610° F. (876.7° C.).

After solution treatment 26, the machined titanium alloy fastener stock is cooled 27. In non-limiting embodiments, cooling 27 may be carried out using, air cooling, water cooling, and/or water quenching, and may be referred to as "fast cooling". Preferably, the cooling rate achieved during cooling 27 is as fast as air cooling. In a non-limiting embodiment, cooling 27 comprises a cooling rate of at least 1,000° F. (555.6° C.) per minute. In a non-limiting embodiment, cooling 27 comprises any cooling process known to a person skilled in the art that achieves the indicated cooling rate. Fast cooling 27 is used to preserve the microstructure obtained by solution treatment 26.

In a non-limiting embodiment, the solution treated 26 and fast cooled 27 titanium alloy fastener stock is aged 28 at an aging treatment temperature in an aging treatment temperature range of about 800° F. (426.7° C.) to about 1,000° F. (537.8° C.) for an aging time in an aging treatment time range of about 4 hours to about 16 hours. In a specific non-limiting embodiment, the solution treated 26 and fast cooled 27 titanium alloy fastener stock is aged 28 at 850° F. (454.4° C.) for 10 hours. In certain non-limiting embodiments, after aging 28, the alpha/beta titanium alloy fastener stock is air cooled 29 or fast cooled to produce an alpha/beta titanium alloy fastener as disclosed herein.

It has been determined that fastener stock manufactured according to this disclosure has higher mechanical properties compared with fastener stock fabricated from Ti-6-4 titanium alloy. Therefore, it is possible to use fasteners fabricated according to this disclosure in smaller dimensions to replace Ti-6-4 fasteners in the same applications. This leads to savings in weight, which is of value in aerospace applications. It also has been determined that in certain applications, fasteners fabricated according to this disclosure could replace steel alloy fasteners having the same dimensions and result in a weight savings of value for aerospace applications.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

EXAMPLE 1

An ingot was produced from compacts made from raw materials using double vacuum arc remelt (VAR) technology. Samples were taken from the ingot for chemical analysis, and the measured average chemistry of the ingot is provided in Table 2. The beta transus temperature of the alloy was determined to be 1,785° F. (973.9° C.).

TABLE 2

| Al | V | Fe | O | N | C | Remainder |
|---|---|---|---|---|---|---|
| 4.06 | 2.52 | 1.71 | 0.284 | 0.008 | 0.017 | Ti and incidental impurities |

EXAMPLE 2

Titanium alloy ingot from several heats having chemical compositions according to this disclosure were hot rolled at a hot rolling temperature of about 1,600° F. (871.1° C.). The hot rolled material was annealed at 1,275° F. (690.6° C.) for 1 hour and air cooled. The annealed material was machined into fastener stock bars and wires having various diameters from about 0.25 inches (6.35 mm) to about 3.5 inches (88.9 mm). The fastener stock bars and wires were solution treated at about 1,610° F. (876.7° C.) for about 1 hour and water quenched. After solution treatment and water quenching, the fastener stock bars and wires were aged at about 850° F. (454.4° C.) for about 10 hours and air cooled.

EXAMPLE 3

Figure 3:
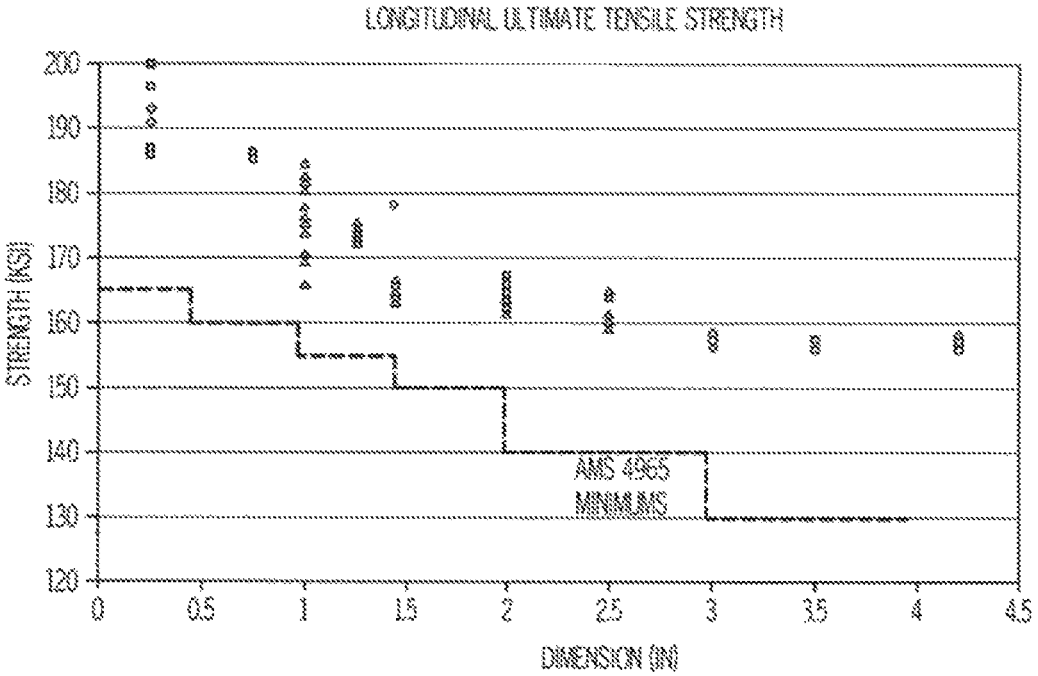
FIG. 3 is a plot of ultimate tensile strength of fastener bar and wire stock made by non-limiting embodiments according to the present disclosure, comparing those properties with requirements for Ti-6Al-4V titanium alloy fastener bar and wire stock.
Figure 4:
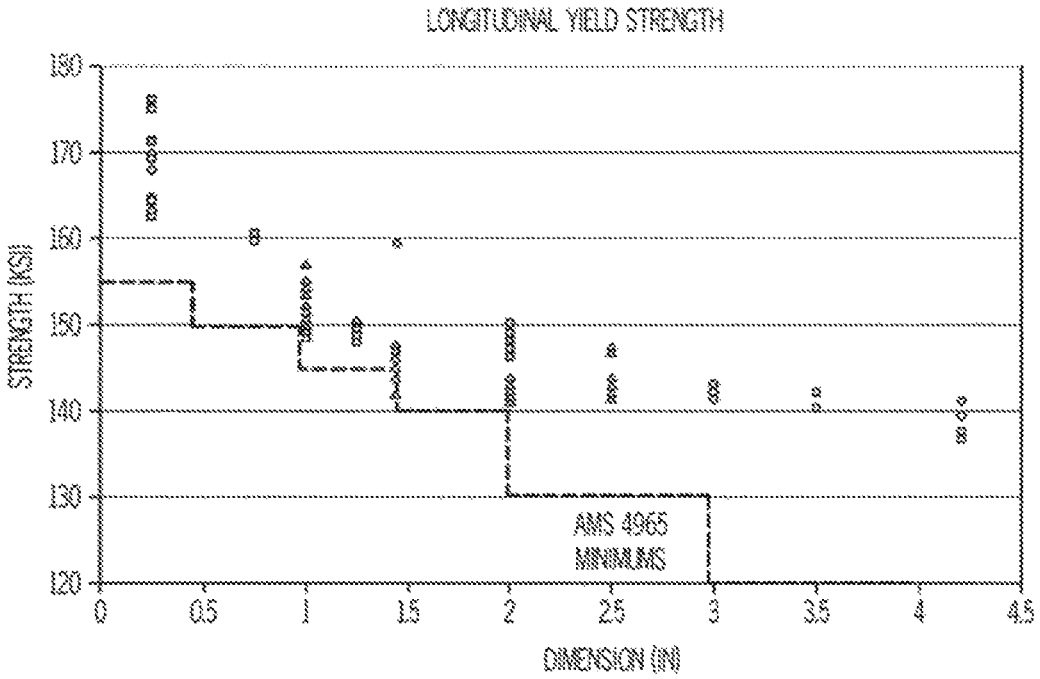
FIG. 4 is a plot of yield strength of fastener bar and wire stock made by non-limiting embodiments according to the present disclosure, comparing those properties with requirements for Ti-6Al-4V titanium alloy fastener bar and wire stock.
Figure 5:
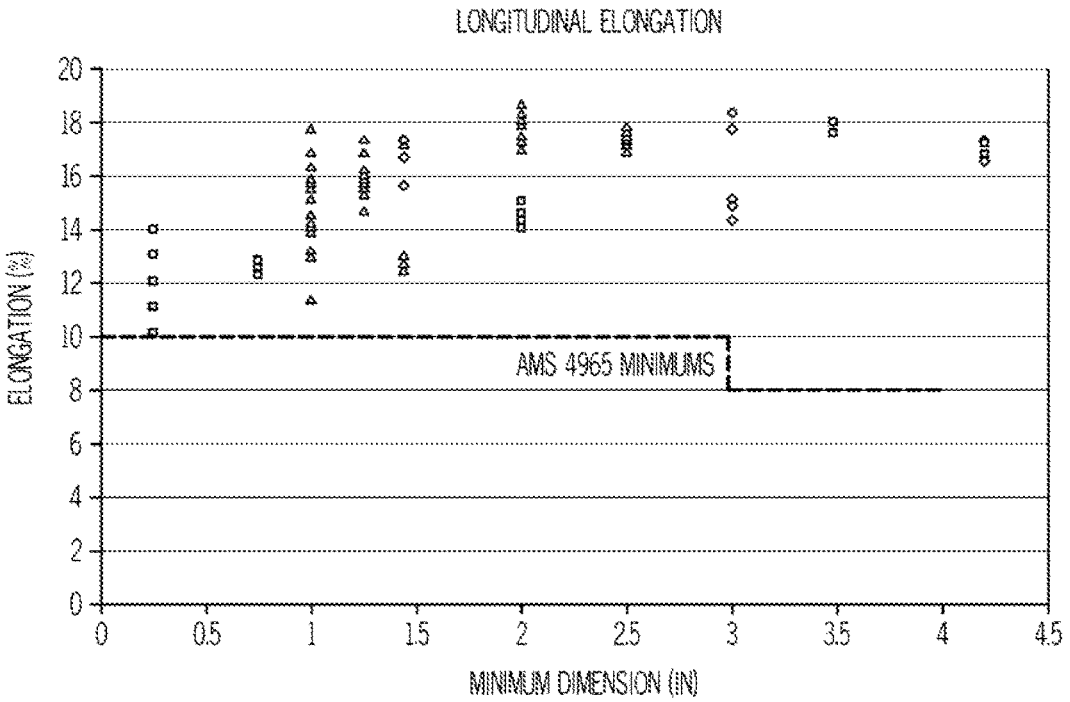
FIG. 5 is a plot of percent elongation of fastener bar and wire stock made by non-limiting embodiments according to the present disclosure, comparing those properties with requirements for Ti-6Al-4V titanium alloy fastener bar and wire stock.

The fastener stock bars and wires from Example 2 were tensile tested at room temperature. The ultimate tensile strengths of the fastener stock bars and wires are presented graphically in FIG. 3. The yield strengths of the fastener stock bars and wires are presented graphically in FIG. 4, and the percent elongations of fastener stock bars and wires are presented graphically in FIG. 5. The minimum ultimate tensile strength, yield strength, and percent elongation required for solution treated and aged Ti-6Al-4V alloy in aerospace fastener applications (AMS 4965) are also illustrated in FIGS. 3-5, respectively. It is seen from FIG. 3 that ultimate tensile strengths measured for the fastener stock bar and wire manufactured according to this disclosure exceeded the illustrated Ti-6Al-4V alloy specifications by the significant amount of approximately 20 ksi (138 MPa) in all measured diameter sizes. Further, it is seen from FIG. 5 that fastener stock having chemical compositions according to this disclosure exhibited percent elongations in the range of at least 10 percent to about 19 percent.

EXAMPLE 4

Fastener stock having a diameter of about 0.25 inches (6.35 mm), having the chemical composition from Example 1, and solution treated and aged as in Example 2 was tensile tested. The results of the tensile tests are listed in Table 3.

TABLE 3

| Ultimate Tensile Strength (ksi) | Yield Strength (ksi) | Percent Elongation | Reduction in Area | Double Shear Strength (ksi) |
|---|---|---|---|---|
| 199.9 | 175.1 | 13.0 | 45 | 123.3 |
| 199.9 | 176.2 | 13.0 | 44 | 120.0 |
| 196.3 | 169.4 | 10.0 | 39 | 117.4 |
| 196.9 | 171.4 | 11.0 | 39 | 117.2 |

The ultimate tensile strengths ranged from about 196 ksi to about 200 ksi (1351 MPa to 1379 MPa), which is higher than the minimum requirements for Ti-6Al-4V fastener stock of 170 ksi (1,172 MPa) UTS and 103 ksi (710 MPa)

DSS. It is also observed that the properties agree with the accepted empirical relationship that DSS=0.6×UTS.

EXAMPLE 5

Fastener stock having a diameter of about 0.75 inches (1.91 cm), having a chemistry from Example 1, and heat treated according to Example 2 was tensile tested. The results of the tensile tests are listed in Table 4.

TABLE 4

| Diameter (inch) | Ultimate Tensile Strength (ksi) | Yield Strength (ksi) | Percent Elongation |
|---|---|---|---|
| 0.75 | 185.9 | 160.3 | 12.3 |
| 0.75 | 185.8 | 160.1 | 12.8 |
| 0.75 | 185.4 | 159.7 | 12.9 |
| 0.75 | 186 | 159.5 | 12.7 |
| 0.75 | 186.1 | 160.3 | 12.4 |
| 0.75 | 186.1 | 160 | 12.4 |
| 0.75 | 186.3 | 160.6 | 12.4 |
| 0.75 | 186.1 | 160.3 | 12.8 |
| Average | 186.0 | 160.1 | 12.6 |
| STD | 0.3 | 0.4 | 0.2 |

The average ultimate tensile strength of the 0.75 inch (1.91 cm) fastener stock bars was 186 ksi (1,282 MPa), which satisfies the minimum specification for fasteners fabricated from A286 iron-base superalloy. Based upon the accepted empirical relationship between DSS and UTS presented hereinabove, the 0.75 inch (1.91 cm) bars are expected to also meet the 108 ksi (744 MPa) DSS requirement for fasteners fabricated from A286 iron-base superalloy.

EXAMPLE 6

Ingot having the chemical composition as in Example 1 is hot rolled, annealed, and machined as in Example 2 to form a fastener stock having a diameter of about 0.75 inches (1.91 cm). The fastener stock is computer numerical control machined into a fastener having a shape of a stud. The stud is solution treated and aged as in Example 2 to form a non-limiting embodiment of a fastener of this disclosure.

EXAMPLE 7

Ingot having the chemical composition as in Example 1 is hot rolled, annealed, and machined as in Example 2 to form a fastener stock having a diameter of about 1 inch (2.54 cm). The fastener stock is roll threaded and cut into pieces having lengths of about 2 inches (5.08 cm). The pieces are cold forged to form hex head bolts. The hex head bolts are solution treated and aged as in Example 2 to form a non-limiting embodiment of a fastener according to this disclosure.

EXAMPLE 7

Ingot having the chemical composition as in Example 1 is hot rolled, annealed, and machined as in Example 2 to form a fastener stock having a diameter of about 1 inch (2.54 cm). The center of the fastener stock is machined to provide a 0.5 inch (1.27 cm) diameter hole. The fastener stock is then cut into pieces having a thickness of 0.125 inches (0.318 cm). The fastener stock is solution treated and aged as in Example 2 to form a non-limiting embodiment of a fastener in the form of a washer according to this disclosure.

The present disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention as defined solely by the claims. Thus, it is contemplated and understood that the present disclosure embraces additional embodiments not expressly set forth herein. Such embodiments may be obtained, for example, by combining and/or modifying any of the disclosed steps, ingredients, constituents, components, elements, features, aspects, and the like, of the embodiments described herein. Thus, this disclosure is not limited by the description of the various exemplary, illustrative, and non-limiting embodiments, but rather solely by the claims. In this manner, it will be understood that the claims may be amended during prosecution of the present patent application to add features to the claimed invention as variously described herein.

I claim:

1. An article of manufacture selected from a titanium alloy fastener and a titanium alloy fastener stock, the article of manufacture including a hot rolled, solution treated and aged alpha/beta titanium alloy comprising, in percent by weight:

3.9 to 4.5 aluminum;
2.2 to 3.0 vanadium;
1.2 to 1.8 iron;
0.24 to 0.3 oxygen;
up to 0.08 carbon;
up to 0.05 nitrogen;
titanium; and
up to a total of 0.3 of other elements;
wherein the article of manufacture has a longitudinal ultimate tensile strength (UTS) of at least 196 ksi (1,351 MPa) and a double shear strength of at least 108 ksi (744.6 MPa), and wherein the article of manufacture comprises a diameter of up to 0.25 inches (6.35 mm).

2. The article of manufacture of claim 1, wherein the other elements consist essentially of one or more of tin, zirconium, molybdenum, chromium, nickel, silicon, copper, niobium, tantalum, manganese, and cobalt, wherein the weight percent of each such element is 0.1 or less, and boron and yttrium, wherein the weight percent of each such element is less than 0.005.

3. The article of manufacture according to claim 1, wherein the fastener comprises one of a bolt, a nut, a stud, a screw, a washer, a lock washer, and a rivet.

4. An article of manufacture selected from a titanium alloy fastener and a titanium alloy fastener stock, the article of manufacture including a hot rolled, solution treated and aged alpha/beta titanium alloy consisting essentially of, in percent by weight:

3.9 to 4.5 aluminum;
2.2 to 3.0 vanadium;
1.2 to 1.8 iron;
0.24 to 0.3 oxygen;
up to 0.08 carbon;
up to 0.05 nitrogen;
no more than a total of 0.3 of other elements;
titanium; and
incidental impurities;
wherein the other elements consist essentially of one or more of tin, zirconium, molybdenum, chromium, nickel, silicon, copper, niobium, tantalum, manganese, and cobalt, wherein the weight percent of each such element is 0.1 or less, and boron and yttrium, wherein the weight percent of each such element is less than 0.005; and wherein the article of manufacture has a longitudinal ultimate tensile strength (UTS) of at least 196 ksi (1,351 MPa) and a double shear strength of at least 108 ksi (744.6 MPa), and wherein the article of manufacture comprises a diameter of up to 0.25 inches (6.35 mm).

5. The article of manufacture according to claim 4, wherein the fastener comprises one of a bolt, a nut, a stud, a screw, a washer, a lock washer, and a rivet.

* * * * *